United States Patent [19]

Schmid

[11] Patent Number: 4,520,662

[45] Date of Patent: Jun. 4, 1985

[54] COUPLER MOUNT ASSEMBLY

[75] Inventor: Hartmut Schmid, North Vancouver, Canada

[73] Assignee: Glenayre Electronics, Ltd., Vancouver, Canada

[21] Appl. No.: 530,724

[22] Filed: Sep. 9, 1983

[51] Int. Cl.[3] ..... G01L 5/28

[52] U.S. Cl. ..... 73/129; 213/75 R

[58] Field of Search ..... 73/129; 188/1.11, 153 R; 213/75 R, 76, 77; 303/86, DIG. 1

[56] References Cited

U.S. PATENT DOCUMENTS

| | | | |
|---|---|---|---|
| 1,658,956 | 2/1928 | Wehr | 248/228 X |
| 2,320,209 | 5/1943 | Bahr | 248/228 X |
| 3,292,888 | 12/1966 | Fischer . | |
| 3,559,941 | 2/1971 | Holzman | 248/228 |
| 3,632,152 | 1/1972 | Renfroe | 248/228 X |
| 4,305,561 | 12/1981 | Hunter et al. | 248/228 |

FOREIGN PATENT DOCUMENTS

| | | | |
|---|---|---|---|
| 2259481 | 6/1973 | Fed. Rep. of Germany . | |
| 2814924 | 10/1978 | Fed. Rep. of Germany . | |
| 114205 | 7/1975 | German Democratic Rep. . | |
| 308897 | 9/1971 | U.S.S.R. | 73/129 |

*Primary Examiner*—Jerry W. Myracle

*Attorney, Agent, or Firm*—Christensen, O'Connor, Johnson & Kindness

[57] ABSTRACT

A coupler mount assembly 14 includes an open-side box to which may be secured a housing 10 of an item of electronics or other equipment. A first jaw member including upper and lower, parallel hooks 54A, 54B and a second jaw member including upper and lower, parallel hooks 58A, 58B are supported by the open-sided box for relative translative movement. To install the coupler mount assembly on the coupler 12 of a railway vehicle, the hooks of the first jaw member are inserted through respective relief holes 84A, 84B in coupler side wall 12A and the hooks of the second jaw member are inserted through respective relief holes 86A, 86B in the coupler side wall. The first and second jaw members are then drawn toward each other by rotation of a rod (through a handle 66) passing through and effectively bearing on the first jaw member and threadedly received in the second jaw member, until the hooks thereof clamp an intermediate portion of the coupler side wall between the relief hole pairs. The open-sided box has flanges 88 and 90, with flange 88 having spaced-apart projections 88A and 88B engaging the coupler side wall adjacent the coupler tip and with flange 90 having projection 90A engaging the coupler side wall at the intermediate portion thereof, to prevent transverse rocking of the coupler mount assembly and to achieve a desired vertical orientation of the housing.

20 Claims, 7 Drawing Figures

COUPLER MOUNT ASSEMBLY

FIELD OF THE INVENTION

This invention generally relates to equipment mounting apparatus, and more particularly to a coupler mount assembly for mounting an item of electronics or other equipment on the coupler of a railway vehicle.

BACKGROUND OF THE INVENTION

In copending application Ser. No. 495,714, filed May 18, 1983, Railway Brake Pressure Monitor, Pomeroy, which is assigned to the assignee of the present invention, a railway brake pressure monitor is disclosed that comprises a sensor/transmitter unit and a remote display unit. In use, the sensor/transmitter unit is mounted on the last vehicle of a railway train and is coupled with the brake pipe of the last vehicle, and the remote display unit is mounted in the locomotive of the railway train. The sensor/transmitter unit includes means for providing an output signal proportional to the air pressure within the brake pipe, means for repetitively monitoring this output signal to measure the value of brake pipe air pressure, means for storing the brake pipe air pressure value, and means for repetitively transmitting a report including the brake pipe air pressure value that is currently stored. The remote display unit includes means for receiving each report from the sensor/transmitter unit, means for extracting the brake pipe air pressure value in each report, and means for displaying the brake pipe air pressure value.

As disclosed in said copending application, the components of the sensor/transmitter unit are mounted in and on a housing. A coupler mount assembly is secured to the coupler at the rear of the last vehicle of the railway train and permits the housing to be readily mounted on and removed from the coupler. The coupler mount assembly includes an open-sided rectangular portion that fits over the knuckle of the coupler. A drawbar fits through aligned openings in the top and bottom walls of the rectangular portion of the coupler mount assembly and through a flag-mounting hole in the coupler knuckle, and is retained in place by an enlarged head at its upper end and by a clip passing through a transverse bore at its lower end. Once the coupler mount assembly has been mounted on the coupler knuckle, the coupler mount assembly is secured thereto by a bolt threadedly engaged in a rear side wall of the rectangular portion of the coupler mount assembly, the bolt bearing against an exterior face of the knuckle to force a bar secured to and extending from an inner front side wall of the rectangular portion into engagement with an opposing, interior face of the knuckle. The coupler mount assembly is provided with a rearwardly opening U-shaped bracket that fits between the coupler knuckle and an opposing portion of the coupler, and the housing of the sensor/transmitter unit is received within and secured to this U-shaped bracket.

Due to the location of the coupler mount assembly and the housing between the coupler knuckle and an opposing portion of the coupler, the coupler cannot be engaged with the coupler of another railway vehicle. Although this location does not present a problem when the railway train has been assembled, it does necessitate removal of not only the housing but also the coupler mount assembly when the train is reassembled or when it is necessary for any reason to couple another railway vehicle to the last vehicle of the train. In this railway brake pressure monitor application and, in fact, in any application in which it is desired to mount an item of electronics or other equipment on the coupler of a railway vehicle, it is accordingly desirable to provide a coupler mount assembly that need not be removed in order for the coupler to be used.

SUMMARY OF THE INVENTION

The coupler mount assembly of the present invention is particularly designed for use with a railway vehicle coupler including a side wall having a convex exterior surface that is provided with a first pair of vertically aligned and spaced-apart relief holes adjacent the coupler tip and a second pair of vertically aligned and spaced-apart relief holes adjacent the coupler base. The coupler mount assembly is adapted to mount an equipment housing on the coupler and comprises:

first and second jaw means, the first jaw means including upper and lower, parallel hooks whose vertical spacing corresponds to the vertical spacing between the relief holes of the first relief hole pair, and the second jaw means including upper and lower, parallel hooks whose vertical spacing corresponds to the vertical spacing between the relief holes of the second relief hole pair;

support means to which the equipment housing may be secured, the support means additionally supporting the first and second jaw means for movement relative to each other and so that the hooks thereof project from the support means and face each other; and, clamping means supported by the support means for drawing the first and second jaw means toward each other, whereby the hooks of the first and second jaw means clamp an intermediate portion of the coupler side wall between the first and second relief hole pairs when the hooks of the first jaw means have been inserted into the first relief hold pair and the hooks of the second jaw means have been inserted into the second relief hole pair.

Preferably, the coupler mount assembly further comprises flange means projecting from and supported by the support means for engaging the convex exterior surface of the coupler side wall when the intermediate portion of the side wall is clamped between the hooks of the first and second jaw means, the flange means being constructed and arranged so as to prevent transverse rocking of the coupler mount assembly and provide a desired vertical orientation of the equipment housing secured thereto.

In the preferred embodiment, the first jaw means is affixed to and stationary relative to the support means and the second jaw means is received by the support means for translative motion therein. The clamping means includes an elongated member having an enlarged portion disposed at the first end thereof and a threaded portion disposed at the second end thereof, the elongated member being rotatively supported proximate its first end by the support means with its enlarged portion bearing on the support means, and the threaded portion at the second end of the elongated member engaging a corresponding threaded portion of the second jaw means. A first resilient member is interposed and compressed between the support means and the enlarged portion of the elongated member, the first resilient member exerting a force on the elongated member when so compressed that tends to move the second jaw means towards the first jaw means. A second resilient member is interposed and compressed between the support means and the second jaw means, the second resilient member exerting a force on the second jaw means when so compressed that tends to move the second jaw means away from the first jaw means. The force exerted by the second resilient member is significantly less than that exerted by the first resilient member. As a result, the first resilient member resists rotation of the elongated member relative to the support means and reinforces the clamping action of the first and second jaw means, and the second resilient member maintains separation between the first and second jaw means when they are loosened.

The coupler mount assembly may be combined with a sensor/transmitter unit of a railway brake pressure monitor, the sensor/transmitter unit including a housing secured to the support means and also including means secured to the housing for coupling the sensor/transmitter unit to the brake pipe of the railway vehicle.

BRIEF DESCRIPTION OF THE DRAWINGS

The invention can best be understood by reference to the following portion of the specification, taken in conjunction with the accompanying drawings in which.

DESCRIPTION OF THE PREFERRED EMBODIMENT

Figure 2:
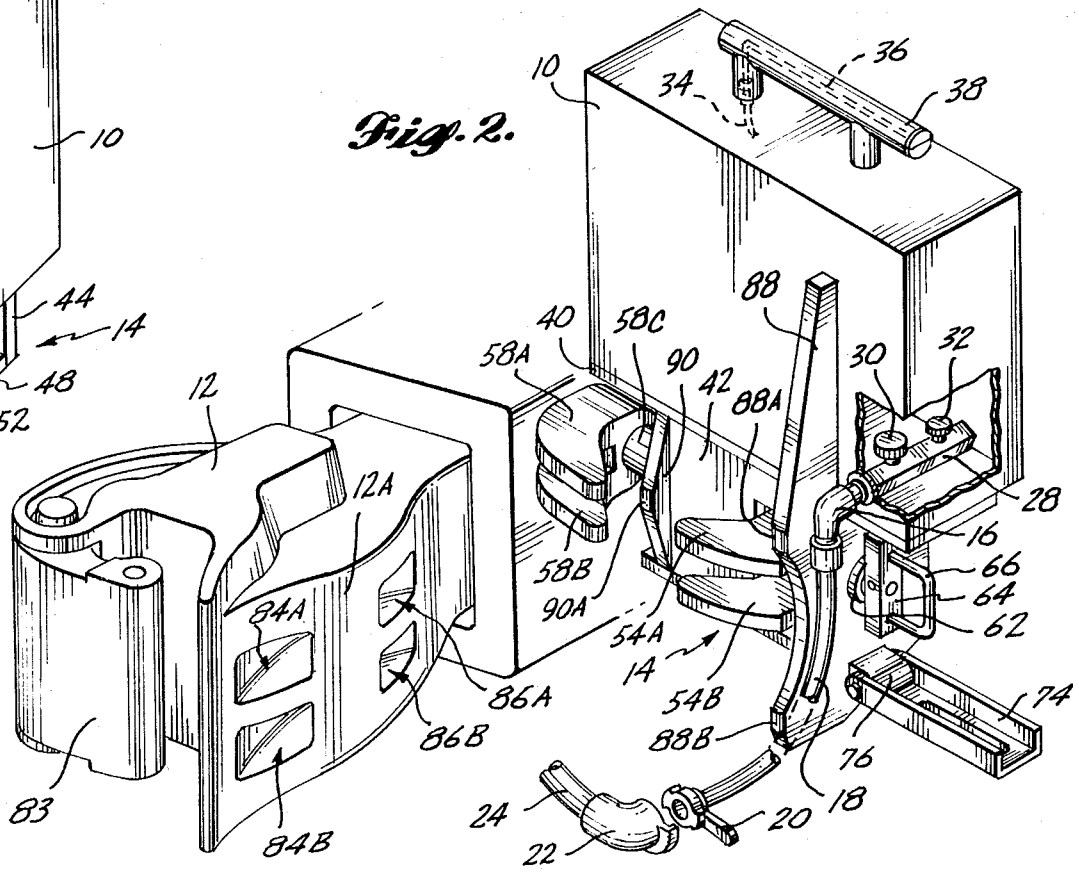
FIG. 2 is an exploded pictorial view of the coupler mount assembly, the housing, the coupler, and fluid interconnections between the housing and the brake pipe of the railway vehicle.
Figure 1:
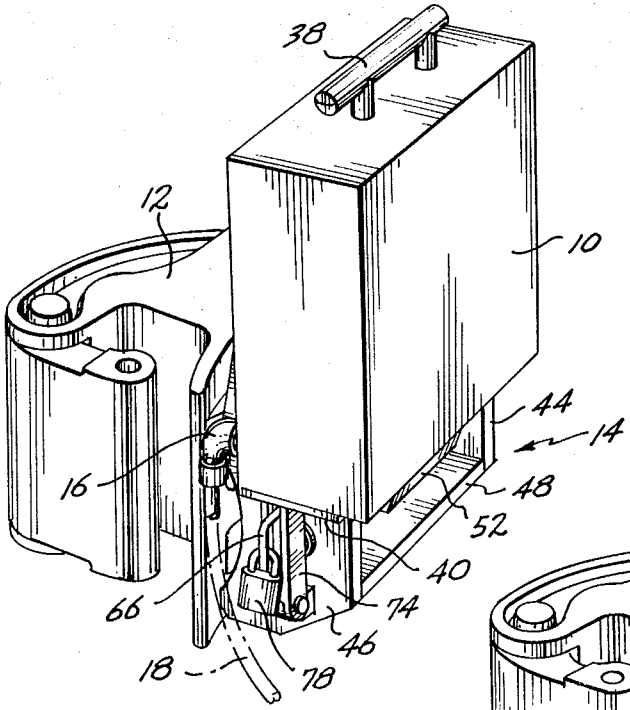
FIG. 1 is a pictorial view of the coupler mount assembly of the invention, having secured thereto the housing of the sensor/transmitter unit of a railway brake pressure monitor and being installed on the coupler of a railway vehicle.
Figure 3:
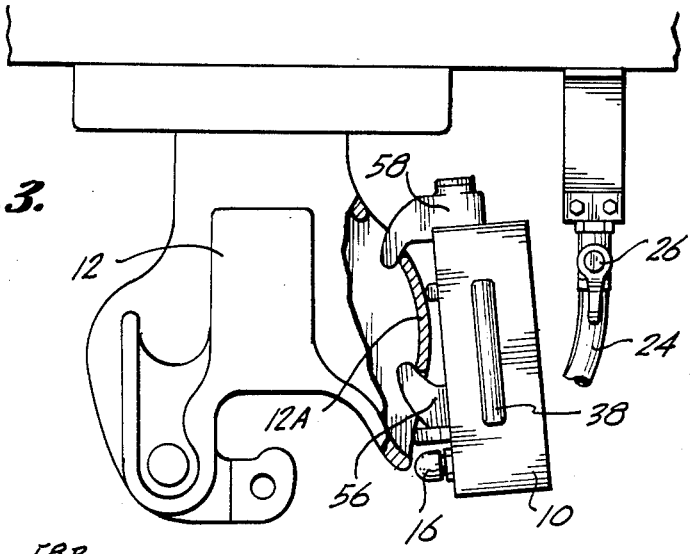
FIG. 3 is a top plan and partial section view of the coupler mount assembly as installed.

Referring now to FIGS. 1, 2, and 3, the housing 10 of the sensor/transmitter unit of a railway brake pressure monitor is mounted on the coupler 12 of a railway vehicle by the coupler mount assembly of the present invention, generally indicated by the reference numeral 14. Housing 10, which has a rectangular configuration, has an elbow 16 exiting from a side wall thereof that is coupled by a flexible hose 18 to a gladhand connector 20. Gladhand connector 20 is adapted to mate with a corresponding gladhand connector 22 that is coupled to the brake pipe (not illustrated) of the railway vehicle through a flexible hose 24 and an angle cock 26. Preferably, gladhand connector 20 includes an integral pressure relief valve (not illustrated) that can be manually actuated to bleed air pressure before disconnection of gladhand connector 20 from gladhand connector 22. Within the housing 10, elbow 16 is coupled to a manifold 28 to which are secured a pneumatic pressure gauge 30 and a pneumatic pressure transducer 32 in fluid communication with manifold 28. When gladhand connectors 20 and 22 are assembled and angle cock 26 is opened, pressure gauge 30 and pressure transducer 32 are accordingly in fluid communication with the brake pipe. The electronic components (not illustrated) contained within housing 10 of the sensor/transmitter unit monitor an electrical output signal from pressure transducer 32, as well as signals representing certain other information, and repetitively transmit a report including the monitored brake pipe air pressure value by applying a modulated RF signal through a lead 34 to an antenna wire 36 disposed within a carrying handle mounted on the top wall of housing 10. Each report is received by a remote display unit mounted in the locomotive of the railway train, which functions to display the brake pipe air pressure values in the reports. For further details concerning the construction and operation of the railway brake pressure monitor, reference should be made to copending application Ser. No. 495,714 which is expressly incorporated by reference herein.

Coupler mount assembly 14 includes a support means comprising an open-sided box composed of a top wall 40 to which housing 10 is permanently or removably secured, a side wall 42 that is proximate coupler 12 when coupler mount assembly 14 is installed, an end wall 44 proximate the railway vehicle, an opposing end wall 46, and a bottom wall 48 opposing top wall 40. With additional reference now to FIGS. 4 through 7, side wall 42 is provided with a rectangular opening 50 adjacent end wall 46 and with an integral socket 52 within the open-sided box and extending from end wall 44 to opening 50. The body 54 of a first jaw member is disposed within the open-sided box and partially within opening 50 adjacent end wall 46, and has integral and projecting, upper and lower, parallel hooks 54A, 54B. In assembly, hooks 54A, 54B project from side wall 42. Hooks 54A and 54B are identical in configuration, each curving toward end wall 44 in assembly and each terminating in a smoothly rounded tip. The body 54 of the first jaw member is also provided with upper and lower shoulders 54C, 54D that bear on the interior surface of side wall 42 above and below opening 50 so as to prevent the first jaw member from moving through opening 50. A cylindrical sleeve 56 passes through a corresponding opening in end wall 46 and a corresponding bore in body 54. At one end, sleeve 56 is provided with an enlarged flange 56A that abuts the exterior of side wall 46, and at the other end, sleeve 56 is received within a corresponding recess at the end of socket 52. The first jaw member is retained on sleeve 56 by a ring 57 bearing on body 54 and received within a corresponding recess of sleeve 56 adjacent the end thereof received in socket 52.

The body 58 of a second jaw member has integral and projecting, upper and lower, parallel hooks 58A, 58B and an elongated cylindrical portion 58C. In assembly, cylindrical portion 58C is received within a corresponding bore that extends through end wall 44 and socket 52 and that is aligned with the longitudinal axis of sleeve 56. Cylindrical portion 58C and its corresponding bore in socket 52 are dimensioned to permit translative movement of second jaw member 58 relative to the open-sided box of the coupler mount assembly. In assembly, hooks 58A and 58B project beyond side wall 42 and are identical in configuration, each curving toward end wall 46 and each terminating in a smoothly rounded tip.

A clamping means is provided for the first and second jaw members that includes a rod 60 disposed within corresponding bores of sleeve 56, socket 52, and cylindrical portion 58C of the second jaw member. A washer 62 is fitted over rod 60 and is disposed in assembly adjacent a rectangular head 64 affixed to one end of rod 60. Head 64 is provided with a handle 66 by which rod 60 may be manually rotated. At its end away from head 64, rod 60 is provided with threads 68. Rod 60 is supported within sleeve 56 (and thus the first jaw member) by an apertured disc 56B integral with sleeve 56 and disposed within the bore therein.Threads 68 on rod 60 are received within corresponding threads of an apertured disc 58D that is integral with and disposed within the bore of cylindrical portion 58C of the second jaw member. An elongated coil spring 70 is disposed within the bore of sleeve 56 and surrounds rod 60, with the ends of spring 70 respectively bearing on washer 62 and on apertured disc 56B. An elongated coil spring 72 is disposed within the bores of sleeve 56, socket 52 and cylindrical portion 58C of the second jaw member, with the ends of spring 72 repectively bearing on apertured disc 56B and on apertured disc 58D. A hasp 74 is pivoted on a bracket 76 secured to end wall 46, with hasp 74 being adapted to fit over handle 66 so as to inhibit rotation of rod 60. Padlock 78 (FIG. 1) may be attached to handle 66. Entry of dirt and other contaminants into the bores of the second jaw member, socket 52, and sleeve 56 is inhibited by a plug 80 fitted into bore at the end of body 58, by a flexible boot 82 fitted around cylindrical portion 58C and abutting end wall 44, and by the close fit of sleeve 56 with socket 52. If desired, boot 82 may be replaced by a seal including a housing affixed to end wall 44 and an O-ring or wiping member supported by that housing and surrounding rod 60.

Referring particularly to FIG. 2, coupler 12 is provided with a portion opposing coupler knuckle 83 that includes a side wall 12A having a convex exterior surface. Side wall 12A is conventionally provided with a first pair of vertically aligned and spaced-apart relief holes 84A and 84B adjacent the coupler tip, and a second pair of vertically aligned and spaced-apart relief holes 86A and 86B adjacent the coupler base. Relief holes 84A and 86A are horizontally aligned and interconnected by an arcuate passageway in coupler 12. Likewise, relief holes 84B and 86B are horizontally aligned and interconnected by an arcuate passageway in coupler 12. In the great majority of railway vehicle couplers, the vertical spacing between the relief holes of each pair is the same; however, the horizontal spacing between the relief hole pairs varies. As can be appreciated from the foregoing description of coupler mount assembly 14, the vertical spacing between hooks 54 and 54B of the first jaw member is chosen to approximate the vertical spacing between relief holes 84A and 84B, and the vertical spacing between hooks 58A and 58B of the second jaw member is chosen to approximate the vertical spacing between relief holes 86A and 86B.

Figure 4:
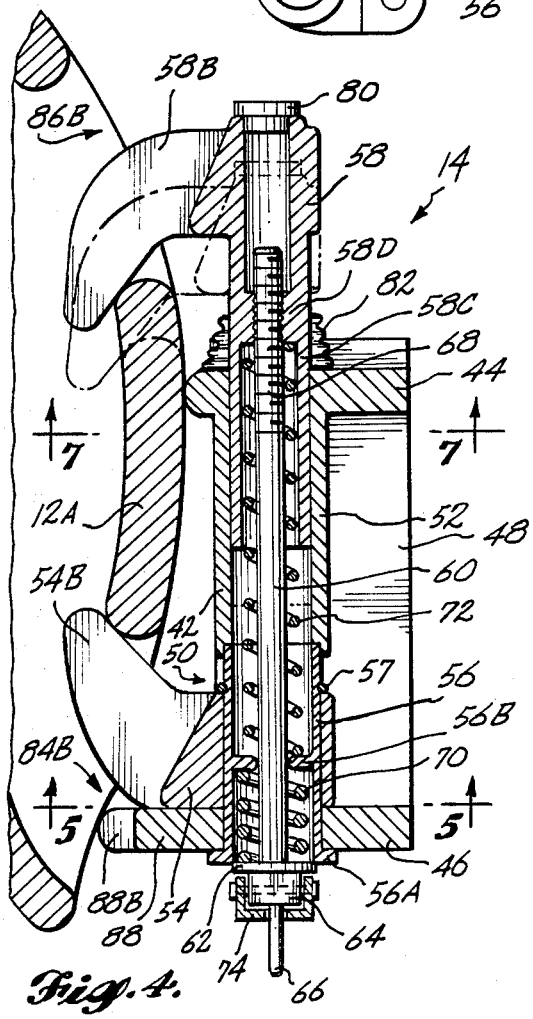
FIG. 4 is an expanded top plan and partial section view of the coupler mount assembly as installed.
Figure 5:
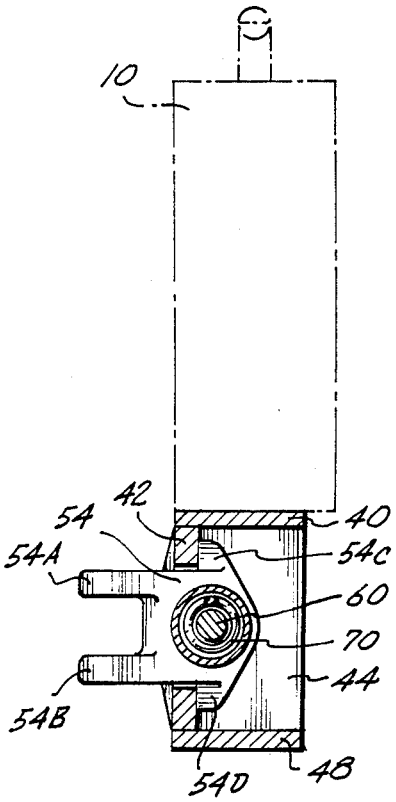
FIG. 5 is a section view of the coupler mount assembly taken along the lines 5—5 in FIG. 4.

To install coupler mount assembly 14, hooks 58A and 58B are inserted through respective relief holes 86A and 86B. The coupler mount assembly is then rotated toward coupler 12 until hooks 54A and 54B enter respective relief holes 84A and 84B. Rod 60 is then rotated (by means of handle 66) so as to draw the second jaw member toward the first jaw member until the respective hooks thereof clamp an intermediate portion of side wall 12A between the relief hole pairs. With particular reference to FIG. 4, it can be appreciated from the solid line and dotted line positions of the intermediate portion of side wall 12A, and from the corresponding solid line and dotted line positions of the second jaw member, that the coupler mount assembly can accommodate a wide variation in horizontal spacing between the relief hole pairs. Spring 70 when compressed exerts a force on the second jaw member (through washer 62 and rod 60) that tends to bring the second jaw member toward the first jaw member, whereas spring 72 when compressed exerts a force on the second jaw member (through apertured disc 58D) that tends to separate the second jaw member from the first jaw member. Due to the construction and material of spring 70 and due to the fact that its noncompressed length is only slightly longer than the distance between apertured disc 56B and flange 56A of sleeve 56, the force exerted by spring 70 is rather large and serves to both resist rotation of rod 60 relative to sleeve 56 and reinforce the clamping action of the first and second jaw members. As a result, the coupler mount assembly does not loosen due to vibration or due to the flaking of hard packed dirt that was present on the intermediate portion of side wall 12A when the coupler mount assembly was first installed. If desired, the function of spring 70 may be provided by a bushing of resilient, yet semi-rigid, elastomeric material. In comparison to the rather large force exerted by spring 70, that of spring 72 is rather small and serves to maintain separation between the first and second jaw members when they are loosened.

Figure 6:
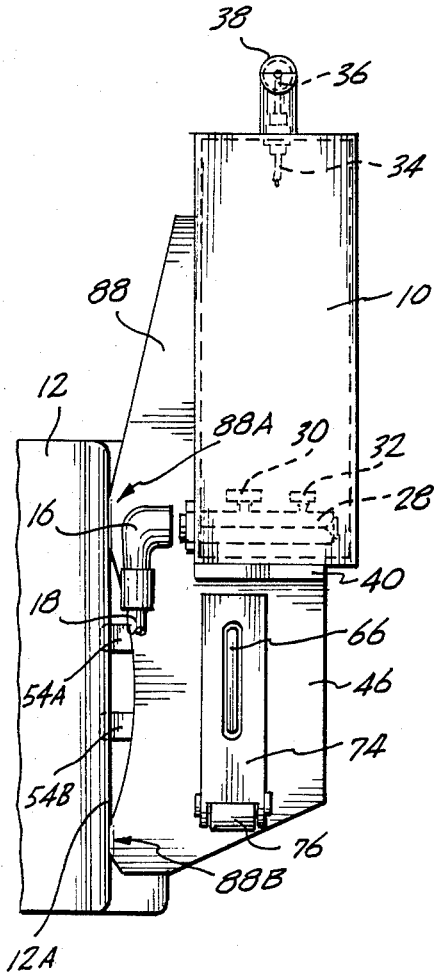
FIG. 6 is a front elevation view of the coupler mount assembly as installed; and, FIG. 7 is a section view taken along the lines 7—7 in FIG. 4.
Figure 7:
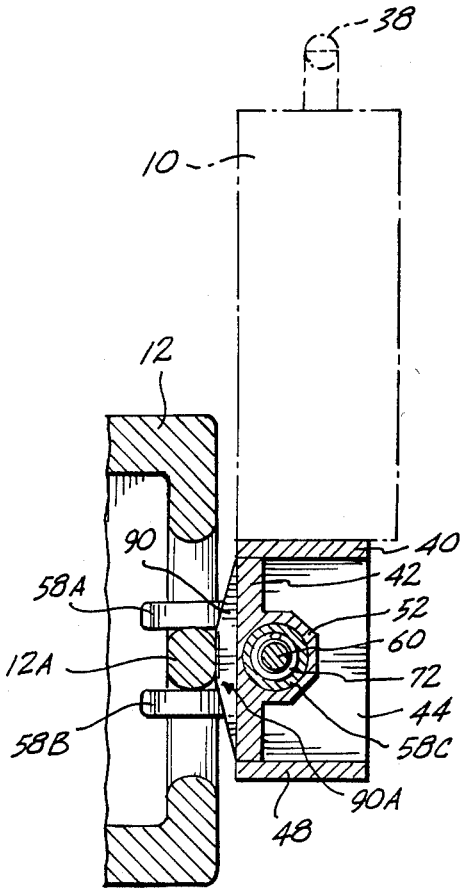

If coupler mount assembly 14 were configured as described to this point, it would tend to rock about an axis transverse to the longitudinal axis of coupler 12 when installed. To prevent this transverse rocking and to obtain a desired vertical orientation of housing 10, the inner surfaces of hooks 54A and 54B of the first jaw member, i.e., those engaging the intermediate portion of the side wall 12A, preferably are inclined from the longitudinal axis of body 54 by about 40°. Further, the open-sided box of coupler mount assembly 14 is provided with spaced-apart flanges 88, 90 extending from side wall 42. Flange 88, that may comprise an extension of end wall 46, includes a vertical extension that serves as a buttress support for housing 10 and also includes vertically spaced projections 88A and 88B. Flange 90, that may comprise an extension of end wall 44, includes a centrally disposed projection 90A. Preferably, projections 88A, 88B and 90B are provided with carbide surfaces to prevent wear. With particular reference to FIG. 6, projections 88A and 88B engage corresponding portions of side wall 12A between relief holes 84A, 84B and the coupler tip. With particular reference to FIG. 7, projection 90A engages the intermediate portion of side wall 12A between the relief hole pairs. As best illustrated in FIG. 3, the aforesaid construction ensures that coupler mount assembly when installed will be substantially disposed behind the coupler tip and slightly canted with respect to the longitudinal axis of the coupler, thereby permitting the coupler to be used without interference. It can be appreciated that the desired orientation of the coupler mount assembly is determined by the structure of, and the spatial relationships among, hooks 54A and 54B, projections 88A and 88B, and projection 90A. Accordingly, the angle of inclination of the inner surfaces of hooks 58A and 58B of the second jaw member is not critical and may be as large as 90° although 50° is preferred.

While the invention has been described with reference to a specific application in which a sensor/transmitter unit of a railway brake pressure monitor is mounted to the coupler of the last vehicle of a railway train, it is to be clearly understood that the coupler mount assembly of the present invention may be used to mount any item of electronics or other equipment on any coupler of any railway vehicle. While the invention has been described with reference to a preferred embodiment, it is likewise to be understood that the invention is not limited thereto and that the scope of the invention is to be interpreted only in conjunction with the appended claims.

The embodiments of the invention in which an exclusive property or privilege is claimed are defined as follows:

1. A coupler mount assembly for use with a railway vehicle coupler including a side wall having a convex exterior surface that is provided with a first pair of vertically aligned and spaced-apart relief holes adjacent the coupler tip and a second pair of vertically aligned and spaced-apart relief holes adjacent the coupler base, said coupler mount assembly being adapted to mount an equipment housing on the coupler and comprising:

first and second jaw means, said first jaw means including upper and lower, parallel hooks whose vertical spacing corresponds to the vertical spacing between the relief holes of the first relief hole pair, said second jaw means including upper and lower, parallel hooks whose vertical spacing corresponds to the vertical spacing between the relief holes of the second relief hole pair;

support means to which the equipment housing may be secured, said support means additionally supporting said first and second jaw means for movement relative to each other and so that the hooks thereof project from said support means and face each other; and, clamping means supported by said support means for drawing said first and second jaw means toward each other, whereby said hooks of said first and second jaw means clamp an intermediate portion of the coupler side wall between the first and second relief hole pairs when said hooks of said first jaw means have been inserted into the first relief hole pair and said hooks of said second jaw means have been inserted into the second relief hole pair.

2. The coupler mount assembly of claim 1, further comprising flange means projecting from and supported by said support means for engaging the convex exterior surface of the coupler side wall when the intermediate portion of the side wall is clamped between said hooks of said first and second jaw means, said flange means being constructed and arranged so as to prevent transverse rocking of said coupler mount assembly and provide a desired vertical orientation of the equipment housing secured thereto.

3. The coupler mount assembly of claim 2, wherein said flange means includes first and second, vertically spaced projections engaging the exterior surface of the coupler side wall adjacent the coupler tip, and a third projection engaging the exterior surface of the coupler side wall at the intermediate portion thereof.

4. The coupler mount assembly of claim 1, wherein one of said first and second jaw means is stationary relative to said support means and the other of said first and second jaw means is movable relative to said support means.

5. The coupler mount assembly of claim 4, wherein said first jaw means is stationary and said second jaw means is movable.

6. The coupler mount assembly of claim 1, wherein said support means supports said first and second jaw means for relative translative movement.

7. The coupler mount assembly of claim 6, wherein said first jaw means is affixed to and stationary relative to said support means and said second jaw means is received by said support means for translative motion therein.

8. The coupler mount assembly of claim 7, wherein said second jaw means includes a threaded portion and wherein said clamping means includes an elongated member having an enlarged portion disposed at a first end thereof and a threaded portion disposed at a second end thereof, said elongated member being rotatably supported proximate said first end by said support means, with said enlarged portion bearing thereon, and said threaded portion at said second end of said elongated member engaging said threaded portion of said second jaw means.

9. The coupler mount assembly of claim 8, wherein said clamping means further includes a first resilient member interposed and compressed between said support means and said enlarged portion of said elongated member, said first resilient member exerting a force on said elongated member when so compressed that tends to move said second jaw means toward said first jaw means.

10. The coupler mount assembly of claim 9, wherein said first resilient member is a coil spring surrounding said elongated member.

11. The coupler mount assembly of claim 9, wherein said clamping means further includes a second resilient member interposed and compressed between said support means and said second jaw means, said second resilient member exerting a force on said second jaw means when so compressed that tends to move said second jaw means away from said first jaw means, the force exerted by said second resilient member being significantly less than that exerted by said first resilient member.

12. The coupler mount assembly of claim 11, wherein said first resilient member is a coil spring surrounding said elongated member.

13. The coupler mount assembly of claim 11, wherein said second resilient member is a coil spring surrounding said elongated member.

14. The coupler mount assembly of claim 1, wherein said first and second jaw means each include a body from which said upper and lower, parallel hook integrally project and wherein said bodies are supported by said support means.

15. In combination with the coupler mount assembly of claim 1, a sensor/transmitter unit of a railway brake pressure monitor, said sensor/transmitter unit including a housing secured to said support means and means secured to said housing for coupling said sensor/transmitter unit to the brake pipe of a railway vehicle.

16. The combination of claim 15, wherein said means for coupling comprises a flexible hose secured to said housing and a gladhand connector disposed at the end of said flexible hose.

17. A coupler mount assembly for use with a railway vehicle coupler including a side wall having a convex exterior surface that is provided with a first pair of vertically aligned and spaced-apart relief holes adjacent the coupler tip and a second pair of vertically aligned and spaced-apart relief holes adjacent the coupler base, said coupler mount assembly being adapted to mount an equipment housing on the coupler and comprising:

first and second jaw means, each of which includes a hook;

support means to which the equipment housing may be secured, said support means additionally supporting said first and second jaw means for movement relative to each other and so that the hooks thereof project from said support means and face each other; and, clamping means supported by said support means for drawing said first and second jaw means toward each other, whereby said hooks of said first and second jaw means clamp an intermediate portion of the coupler side wall between the first and second relief hole pairs when said hook of said first jaw means has been inserted into one hole of the first relief hole pair and said hook of said second jaw means has been inserted into a corresponding hole of the second relief hole pair.

18. The coupler mount assembly of claim 17, further comprising flange means projecting from and supported by said support means for engaging the convex exterior surface of the coupler side wall when the intermediate portion of the side wall is clamped between said hooks of said first and second jaw means, said flange means being constructed and arranged so as to prevent transverse rocking of said coupler mount assembly and provide a desired vertical orientation of the equipment housing secured thereto.

19. In combination with the coupler mount assembly of claim 17, a sensor/transmitter unit of a railway brake pressure monitor, said sensor/transmitter unit including a housing secured to said support means and means secured to said housing for coupling said sensor/transmitter unit to the brake pipe of a railway vehicle.

20. The combination of claim 19, wherein said means for coupling comprises a flexible hose secured to said housing and a gladhand connector disposed at the end of said flexible hose.

* * * * *

Notice of Adverse Decisions in Interference

In Interference No. 101,561, involving Patent No. 4,520,662, H. Schmid, COUPLER MOUNT ASSEMBLY, final judgment adverse to the patentee was rendered March 29, 1989, as to claims 1, 4-8, 14-17, 19 and 20.

*(Official Gazette August 27, 1991)*